United States Patent [19]

Allwin

[11] Patent Number: 5,074,362

[45] Date of Patent: Dec. 24, 1991

[54] FINGER NUT SETTING TOOL AND LINER HANGER ASSEMBLY

[75] Inventor: Roger P. Allwin, College Station, Tex.

[73] Assignee: Lindsey Completion Systems, Inc., Houston, Tex.

[21] Appl. No.: 579,653

[22] Filed: Sep. 10, 1990

[51] Int. Cl.[5] ..... E21B 23/00; E21B 43/10

[52] U.S. Cl. ..... 166/382; 166/208; 166/217

[58] Field of Search ..... 166/382, 208, 216, 217, 166/138, 123, 285, 237, 290

[56] References Cited

U.S. PATENT DOCUMENTS

| | | | |
|---|---|---|---|
| 3,136,367 | 6/1964 | Wright et al. | 166/208 |
| 3,158,201 | 11/1964 | Springer | 166/208 X |
| 4,598,774 | 7/1986 | Nevels et al. | 166/382 |
| 4,834,185 | 5/1989 | Braddick | 166/382 |
| 4,993,493 | 2/1991 | Arnold | 166/382 |

*Primary Examiner*—Stephen J. Novosad

[57] ABSTRACT

A setting tool for a liner hanger in an oil well completion system wherein the setting tool mechanism incorporates structure for manipulating a liner prior to and subsequent to hanging the liner hanger in a well casing. Prior to setting the liner hanger the setting tool release nut is locked to a liner hanger by a releasable lug interconnection. After hanging the liner hanger, the lug interconnection is released and rotation of the setting tool mandrel uncouples the coupling nut from the liner hanger to release the setting tool from the liner hanger and further rotation of the coupling nut locks the coupling nut to the clutch housing so that the liner can be rotated after it is hung in a well casing.

23 Claims, 3 Drawing Sheets

FINGER NUT SETTING TOOL AND LINER HANGER ASSEMBLY

RELATED APPLICATIONS

This application is related to Ser. No. 579,654, filed Sep. 10, 1990, and entitled, "Double Nut Setting Tool and Liner Hanger Assembly"; and to Ser. No. 07/579,547, filed Sep. 10, 1990, and entitled, "Setting Tool and Liner Hanger Assembly".

FIELD OF THE INVENTION

This invention relates to setting tools and liner hangers in oil well completions, and more particularly to a setting tool which can be utilized to rotate a liner either before or after the liner hanger is hung in a well bore.

BACKGROUND OF THE PRESENT INVENTION

During the drilling and completion of an oil well where a borehole traverses earth formations, it is customary to install one or more liners (tubular strings of pipe) in the borehole where the liners are cemented in the borehole by filling the annulus between the liner and the borehole with cement. In installing a liner (which is a string of pipe), the upper end of the liner is connected to a tubular liner hanger which typically has circumferentially arranged exterior slip or wall engaging members where the slip members are in a retracted condition while the liner hanger is lowered into the borehole. The slip members can be set to engage a wall by either hydraulically actuated means or mechanical mechanisms and the liner hanger has an interior left-hand thread which is used for releasably coupling the liner hanger to a tubular setting tool. The setting tool has a matching left-hand threaded release nut for coupling with the liner hanger and has a supporting tubular mandrel with a non-circular exterior portion which is slidably but non-rotatably connected in the bore of the release nut. Below the release nut the supporting mandrel has a load supporting cylindrically shaped, upwardly facing shoulder which engages the release nut so that the weight of the liner is carried by the nut on the mandrel shoulder. The upper end of the setting tool mandrel is connected to a string of pipe which is used to lower the liner and the liner hanger into position in the borehole. While lowering the liner into the borehole it is sometimes desirable to rotate the liner in a right hand direction. This requires an ability impart rotation to the liner hanger through the setting tool without releasing the release nut. This type of rotation can be accomplished by utilizing a set of longitudinal interengaging splines located between the liner hanger and setting tool mandrel in a well known manner.

When a liner hanger is lowered to a position adjacent to the lower end of the next above casing or liner, the slip members on the liner hanger are set to engage with the surrounding pipe wall. Setting of the slip members can be accomplished by hydraulic actuation or by mechanical actuation.

A hydraulically operated liner hanger utilizes hydraulic pressure in the string of pipe and in the setting tool to actuate an axially movable hydraulic cylinder which moves and causes the slip members on the liner hanger to extend outwardly into gripping engagement with the wall of the surrounding casing or liner. In a mechanically actuated liner hanger, a friction block means on the liner hanger frictionally engages a casing or liner so that an interconnecting "J" slot release mechanism can be operated by manipulation of the setting tool to permit the slip members to be set.

If splines are used in the setting tool to enable rotation of a liner prior to the setting of the liner hanger slips, the splines in the setting tool are disengaged after the liner hanger slips are set by longitudinal movement of the supporting string of tubing. The non-circular portion of the mandrel permits longitudinal movement of the setting tool mandrel with the string of tubing. After disengaging the setting tool splines, right-hand rotation of the string of tubing releases the threaded release nut from the interior threaded connection with the liner hanger. The setting tool in a released position in the liner hanger also has pressure sealing means located in the bore of the liner hanger so that the string of tubing is in fluid communication with the bore of the liner. In this condition, before removing the released setting tool from the liner hanger, a cement slurry is pumped down the string of tubing and the liner bore and into the annulus between the liner and the borehole.

The cement slurry which is introduced to the annulus moves upwardly in the annulus between the liner and the borehole. As the cement slurry travels upwardly in the annulus, it displaces the drilling mud in the well bore above the cement. If the liner is reciprocated and/or rotated during the cementing operation, this movement will greatly assist the obtaining of a uniform distribution of the cement in the annulus and proper displacement of the drilling mud in the annulus without channeling of the cement through the mud.

In recent years liner hangers have incorporated a rotatable bearing between horizontal load bearing surfaces in the liner hanger so that when the slips of the liner hanger are set and the liner is suspended by the liner hanger slips from the next above string of well pipe, the liner is supported in the liner hanger on a rotational bearing. The rotational bearing then facilitates rotation of the liner relative to the liner hanger after setting the liner hanger slips. Examples of rotatable load bearing bearings and liners hangers are shown in U.S. Pat. No. 4,033,640 and U.S. Pat. No. 4,190,300.

In order to rotate the liner during the cementing operation, the released setting tool must be coupled to the liner hanger so that rotation of the string of tubing can permit the liner to be rotated as much as desired during the cementing operation. It is desirable that the setting tool remain released from the liner hanger so that it can be pulled out of the well by an upward movement of the drill string at any time during the operation.

Prior art systems for rotating liner hangers and setting tools prior to setting of the slips are well known and typically utilize a single set of splines. In U.S. Pat. No. 4,562,889, and co-pending patent application Ser. No. 609,104, filed May 10, 1984, dual spline arrangements are shown where a second set of splines can be engaged upon release of the release nut so that the liner and setting tool can be co-rotatively rotated while the release nut is released. These systems however require extra spline housing components in the liner hanger and a special setting tool which does not have a universal use.

When the liner hanger for the liner is set in the casing, it is set so the bottom of the cement shoe on the liner is just located above the bottom of the borehole a sufficient distance to eliminate the possibility of fouling of the cement shoe orifices and so that the liner hanger slips can engage the next above casing or liner. As may be appreciated, the cementing operation requires considerable care because once the cement slurry is in the annulus, the liner cannot be removed and repositioned since the cement is already in place. Also, if the releasing mechanism in the setting tool is not disengaged from the liner hanger prior to the cement slurry hardening up, the drill string can be hung up in place. Such malfunctions can result in the loss of well equipment in the well or even destroying the well.

SUMMARY OF THE INVENTION

The present invention involves a setting tool for a liner hanger which incorporates a coupling mechanism for interconnecting the setting tool and the liner hanger for co-rotation prior to and after release of the release nut from a liner hanger. The liner hanger, which is connected to a liner, is provided at its upper end with a left hand internal threaded section which threadedly receives the release nut on a setting tool. The liner hanger also has an upwardly facing clutch surface on an upwardly facing end surface and has an annular locking recess located below the threaded section.

The setting tool is adapted for connection with a tubing string or drill string and has a tubular mandrel with a longitudinally extending recess located between an upper bearing means and a lower load bearing flange. A release nut is slidably and co-rotatively coupled to a non-circular section of the mandrel located in a lower section or length of the recess. The release nut has depending and elongated finger or collet portions extending into a liner hanger with terminal locking lugs disposable in the annular locking recess in the liner hanger. The locking lugs are normally locked into the annular recess by a locking surface on the mandrel in a first position of the mandrel for going into a well bore. The locking lugs are released by relative longitudinal movement between the setting tool mandrel and release nut to a second position of the setting tool mandrel. A tubular clutch housing is slidably mounted on the setting tool mandrel at a location above the non-circular section and has an internal threaded portion which is threadedly coupled to the upper end of the release nut thread. The clutch housing has a downwardly facing clutch fingers or portions on an annular end surface which interengage with the upwardly facing clutch fingers or surfaces on the end of the liner hanger. The clutch portions can be disengaged by longitudinal movement of the clutch housing relative to the liner hanger.

In a casing and in a condition as described above, the liner hanger is co-rotatable with the setting tool mandrel prior to setting the slips of the liner hanger by virtue of locking lugs on the release nut being locked in place which prevents rotation of the nut. When the liner hanger is in position to be hung in a casing, the liner hanger slips can be set mechanically or hydraulically when the liner is properly located.

After setting the liner hanger slips, the tubing string and the setting tool mandrel are lowered relative to the release nut (between the first and second positions) to disengage the locking surface on the mandrel from the locking lugs on the release nut so that the mandrel can be rotated by the string of tubing to release the release nut from the threaded connection with the liner hanger. The lowering of the setting tool mandrel brings the rotatable bearing on the setting tool mandrel into engagement with the clutch housing and weight on the string of tubing holds the clutch teeth of the clutch housing and the liner hanger in interengagement. The recess in the clutch housing above the release nut threadedly receives the release nut as it is rotated free of the liner hanger. After a given number of rotations, the release nut is threadedly disengaged from the liner hanger threaded connection by rotation and the setting tool is released or disconnected from the liner hanger. Further rotation of the setting tool mandrel rotates the release nut into joining engagement with the clutch housing. Since the liner hanger and clutch housing are coupled through the interengaged clutch teeth while the liner hanger is set rotation of the setting tool rotates the liner while the release nut is released from the liner hanger. The setting tool is removable by an upward pull on the string of tubing.

IN THE DRAWINGS

Figure 4:
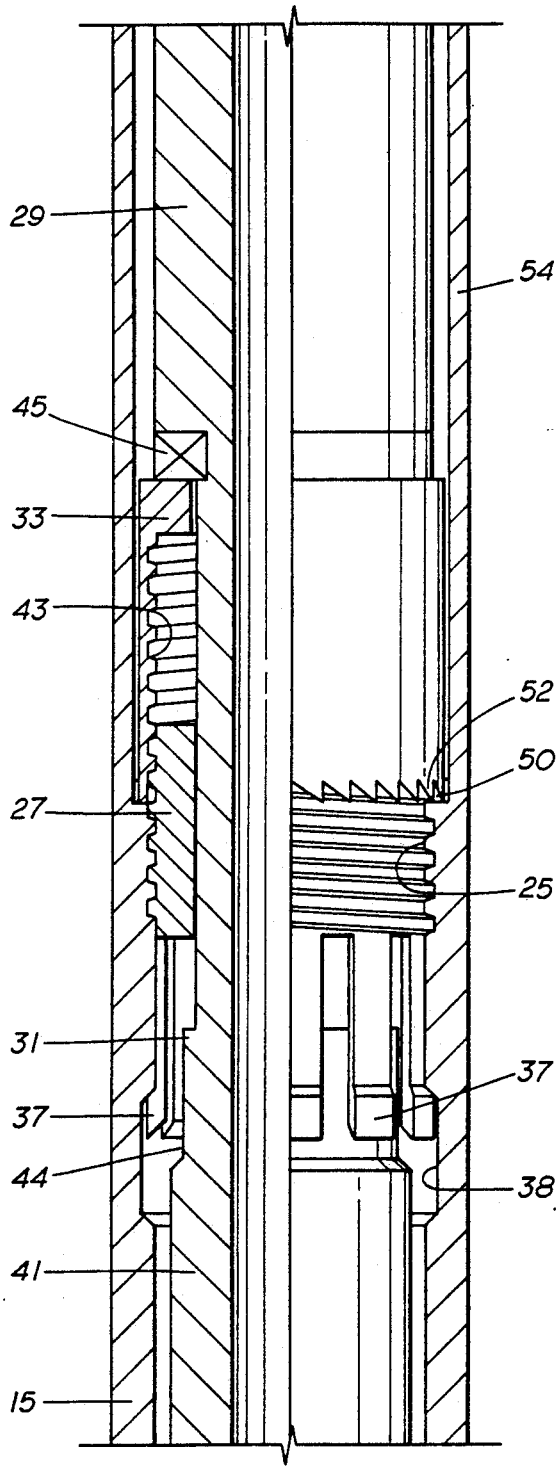
Figure 5:
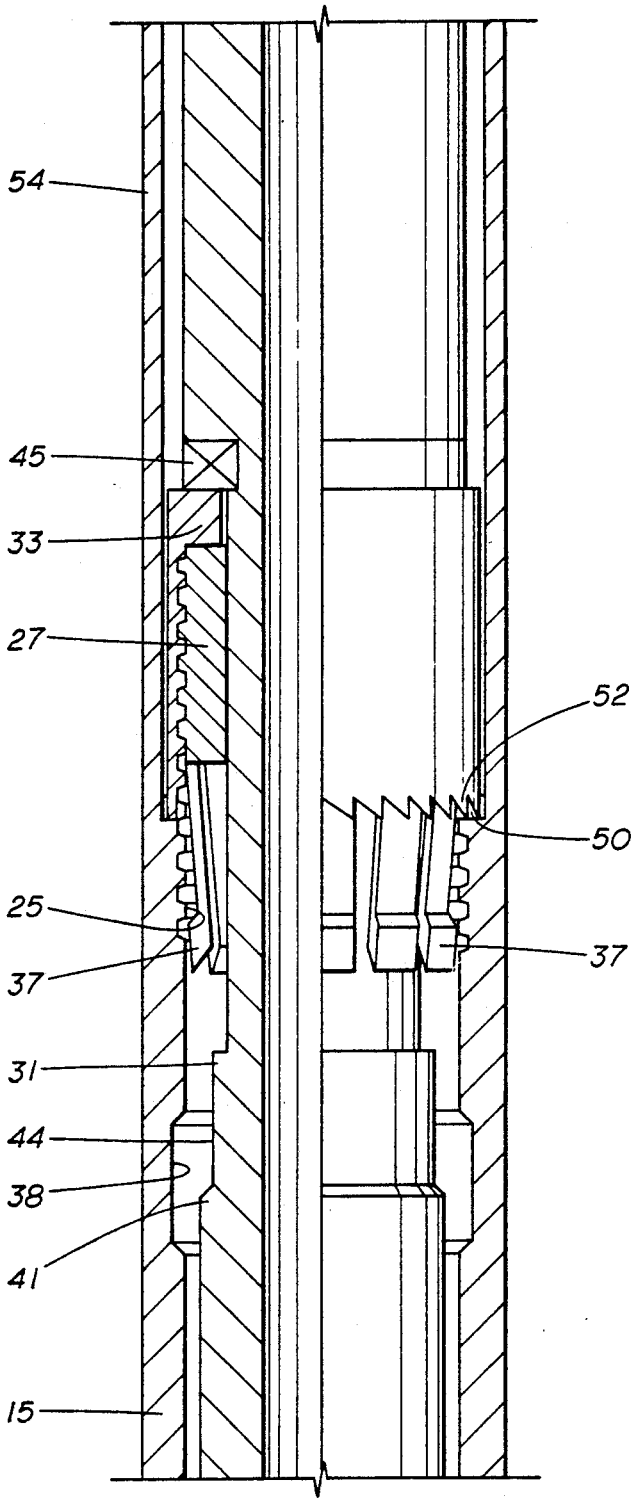
Figure 6:
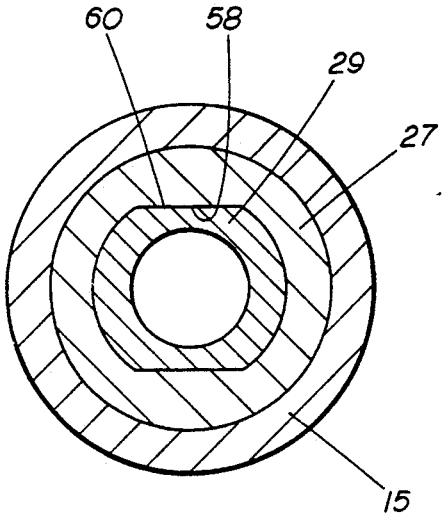

FIG. 4 is an illustration in partial longitudinal cross section of the setting tool assembly of the present invention in a position to release the release nut; and FIG. 5 is an illustration in partial longitudinal cross section of the setting tool with the release nut released; and FIG. 6 is an illustration in partial cross section of a setting tool and a liner in a released position after the liner is hung in the casing.

DETAILED DESCRIPTION OF THE INVENTION

Figure 1:
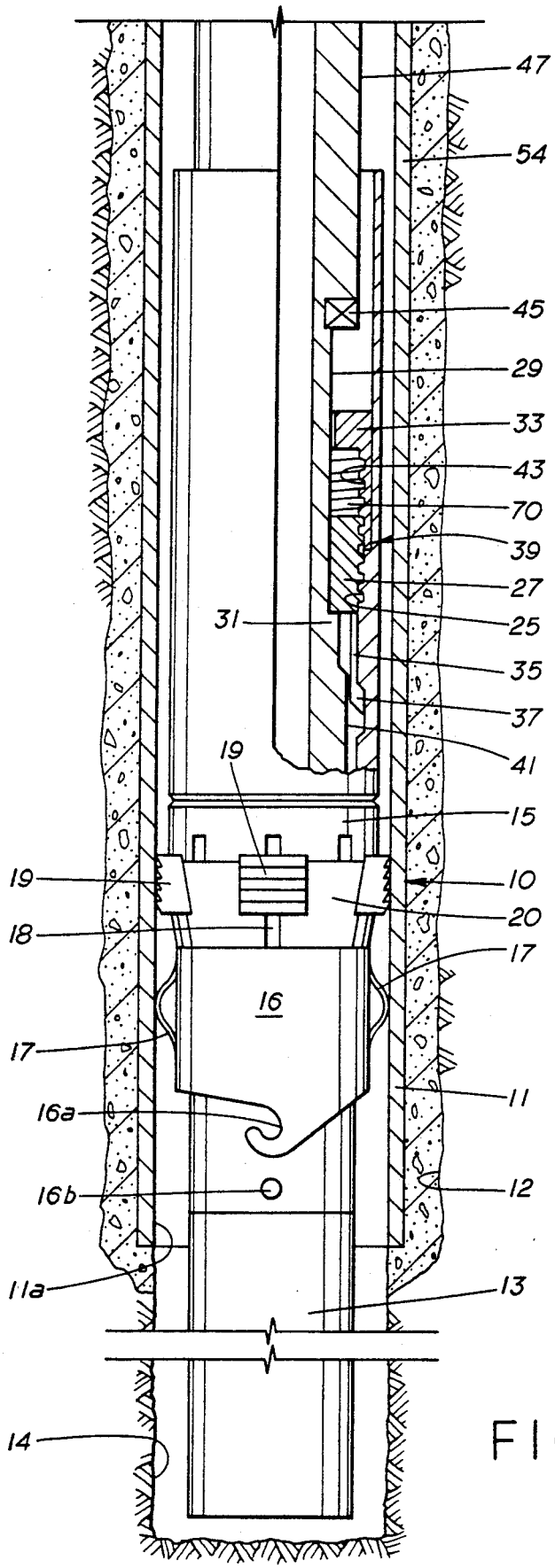
FIG. 1 is an overall schematic view of a liner hanger disposed in a well bore.

Referring now to FIG. 1, a liner hanger assembly 10 is shown in a set position at the lower end of a well casing 11 which has been cemented in a borehole 12. The liner hanger assembly 10 is coupled to a lower depending liner 13 to be cemented in a borehole 14 located below the liner hanger assembly 10.

Figure 2:
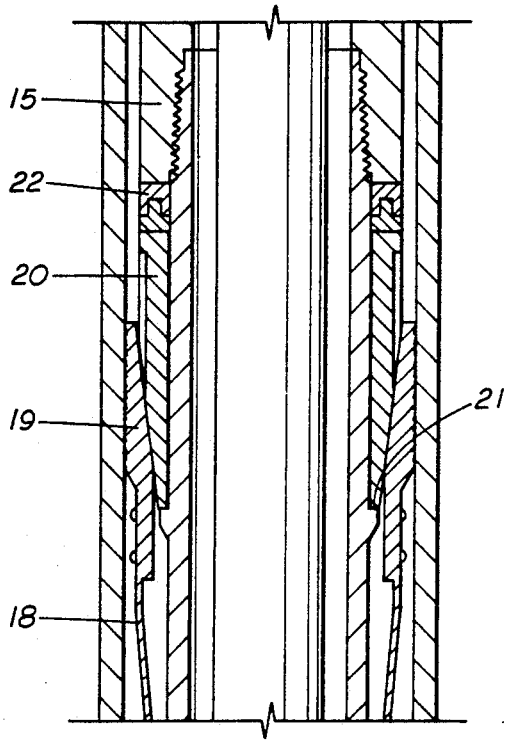
FIG. 2 is a view in longitudinal cross section of the expander cone as related to the supporting member to facilitate ease of rotation.

The liner hanger assembly 10 includes a tubular hanger member 15 which is coupled by a threaded connection to the liner 13. The tubular hanger member 15 carries at its lower end, a tubular J-slot sleeve or cage 16 which has J-hooks or J-slots 16A which are adapted to be releasably connected with respect to J-pins 16B on the hanger member 15. The tubular cage 16 has external friction pads or springs 17 which frictionally engage the interior wall 11A of the casing 11 and prevent the cage 16 from relative rotational movement during the latching or unlatching of the J-pins from the J-hooks. The J-slot cage 16 is attached by longitudinally extending straps 18 to slip members 19 which are circumferentially disposed about the periphery of the hanger member 15. (See also FIG. 2). The slip members 19 have inner tapered surfaces which slide upon an inclined expander cone 20. The expander cone 20 is rotatively mounted on the hanger member 15 between a lower stop shoulder 21 and an upper rotatable bearing 22 (FIG. 2).

Figure 3:
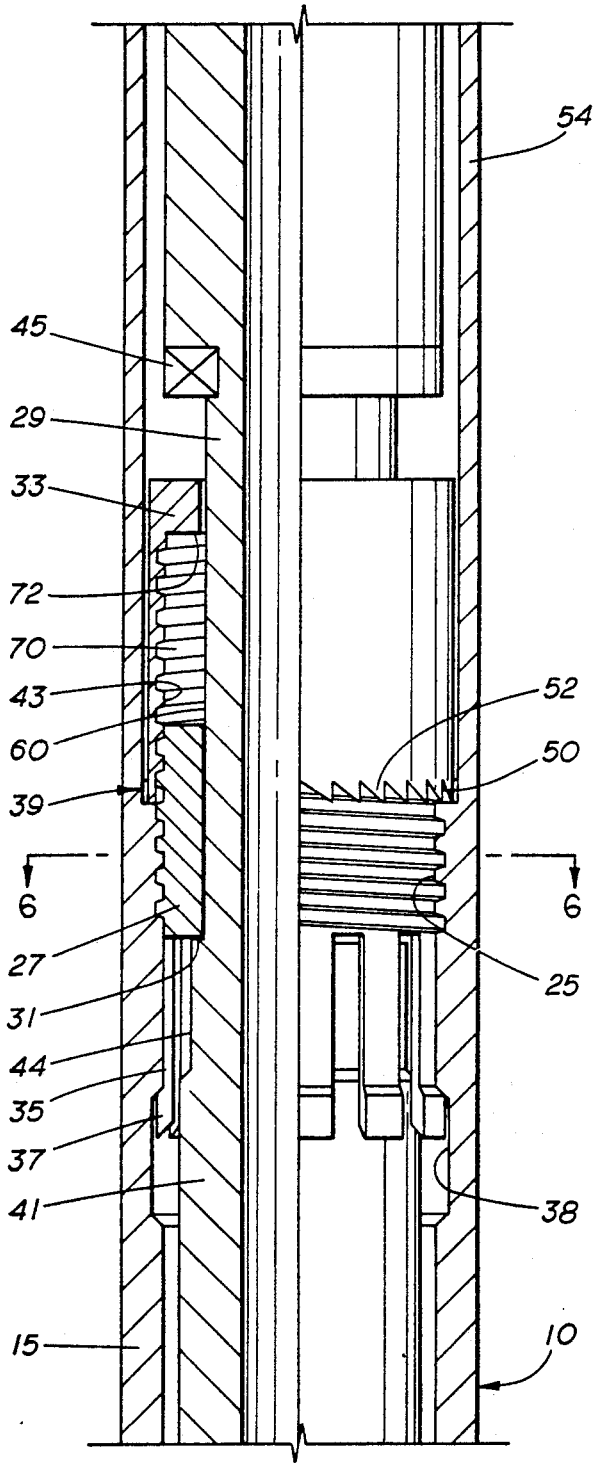
FIG. 3 is an illustration in partial cross section of a setting tool and a liner hanger in a going-in position.

As shown in FIG. 1 and FIG. 3, the liner hanger assembly 10 at its upper end has an internal left-hand thread 25 for threaded coupling to a releasable coupling or release nut 27 on a setting tool mandrel 29. The setting tool mandrel 29 has a slidable but non-rotatable connection with the coupling nut 27 (see FIG. 6) and has a flange 31 below the coupling nut which supports the load of the liner through engagement with the coupling nut 27. A tubular clutch housing 33 is slidably mounted on the setting tool mandrel 29. The clutch housing has clutch teeth at 39 which mesh with clutch teeth on the end of the liner hanger member 15. The release nut 27 has depending collet fingers 35 which terminate with locking lugs 37 disposed in an annular recess 38 in the liner hanger. A locking surface 41 on the mandrel 27 maintains the locking lugs 37 in the recess so that the nut 27 cannot rotate. This permits the setting tool mandrel 29 to be rotatively coupled to the liner hanger 10 while going in a well bore.

The clutch housing 33 has an internal left-hand thread 43 which is threadedly engaged by an upper end of the release nut 27. After setting the slips 19 (shown in FIG. 1), the setting tool mandrel 29 is lowered, which releases the locking lugs from the recess in the liner hanger. This occurs because a recessed surface 44 is disposed adjacent to the locking lugs 37. The mandrel 29 is lowered until a bearing 45 on the setting tool mandrel 29 engages the upper end of the clutch housing 33. Right-hand rotation of the setting tool mandrel 29 rotates the coupling nut 27 so that the nut 27 moves upwardly relative to the setting tool mandrel 29. After about ten turns, the coupling nut 27 disengages from its threaded connection with the liner hanger 10. The release nut 27 is also located in the recess 70 in the clutch housing 33 and two or three additional turns will move the nut 27 further into the recess 70 to lock the nut 27 in the clutch housing 33 by engagement of the nut 27 with the internal end surface of the recess in the clutch housing. housing. The down weight on the string of tubing 47 is transmitted through the bearing 45 to maintain the clutch teeth at 39 in engagement and with the nut 27 in a jamming engagement with the clutch housing 33 so that rotation of the clutch housing 33 and hence rotation of the liner 13 can be accomplished after the liner hanger slips 19 are set.

As shown in FIG. 3, the upper end of the liner hanger assembly 10 is illustrated with its internal left-hand thread 25 for threaded coupling to the coupling nut 27 of the setting tool. On an upwardly facing internally located end surface of the liner hanger member 15 are circumferentially arranged, upwardly extending clutch teeth or surfaces 50 which are arranged in a saw tooth relationship so as to mesh or engage with downwardly facing clutch teeth or surfaces 52 on the clutch housing 33 (FIG. 3) on the setting tool assembly. The clutch teeth or surfaces 50,52 can be engaged by moving the surfaces 52 on the clutch housing 32 downward into engagement with the surfaces 50 on the liner hanger member 15. Conversely, the surfaces 50,52 can be disengaged from one another by longitudinally moving the clutch housing 33 in an upward direction relative to the liner hanger member 15. A tubular guide housing 54 may be threadedly coupled to the upper end of the liner hanger member 15 to protect the surfaces 50 and provide a guiding function. Below the thread 25, the member 15 has an internal annular recess 38 for receiving locking dogs 37 on the release nut 27.

The setting tool as illustrated in FIG. 3 includes the setting tool mandrel 29 which has the coupling nut 27 which is normally seated on the load supporting flange 31. The coupling nut 27 has an external left-hand machine thread and an internal bore 58 with a non-circular cross section which slidably and co-rotatively receives a non-circular cross section 60 of a length of the mandrel 29. (See FIG. 6) The coupling nut 27 has circumferentially arranged depending collet fingers which terminate with locking lugs 37 which are normally disposed in the annular recess 38 in the liner hanger in a going-in condition of the tool.

The release nut 27 has an upper portion of its external left hand thread which engages an internal left-hand thread 43 in the tubular clutch housing 33. While a single nut is illustrated, two nuts could be utilized instead of a single nut.

The setting tool is assembled with the liner hanger as shown in FIG. 3, with the threaded coupling nut 27 in threaded engagement with the threads 25 on the liner hanger., the clutch surfaces 52 on the clutch housing in engagement with the clutch surfaces 50 on the liner hanger; the spline lugs 35 in engagement with the spline grooves 37 of the setting tool. As such, the setting tool, liner hanger and liner can be lowered into the well bore by a tubing string to the desired location. At any time rotation and/or reciprocation of the tubing string will produce rotation or reciprocation of the liner without affecting the setting tool coupling arrangement.

At a desired location in the well bore, the liner hanger slips are set to hang the liner in the well bore and support the weight of the liner on the liner hanger slips. Next the tubing string is slacked off (lowered) to move the enlarged portion on the mandrel 29 downwardly and release the lug interconnection with the lug recess 35 in the liner. The tubing string 47 is lowered until the bearing 45 on the setting tool mandrel 29 engages the clutch housing 33 and applies weight to maintain the clutch surfaces 50,52 at 39 in engagement. Following this downward stroke, the tubing string is rotated in a right-hand direction to rotate the release nut 27. The release nut 27 unscrews from the threaded connection with the liner hanger and moves upwardly in the internal recess 70 in clutch housing 33. The arrangement is such that the release nut 27 uncouples and releases from the liner hanger 15 prior to engaging the end surface 72 in the recess 70 in the clutch housing 33. After the release nut 27 is free or released from the liner hanger thread 25, further rotation causes the release nut 27 to engage the end surface 72 in the clutch housing recess 60. This engagement of the release nut 27 locks the mandrel 29 to the clutch housing 33. Since the clutch housing is coupled by the clutch surfaces 50,52 to the liner hanger, rotation of the mandrel rotates the liner after the liner hanger is set and while the setting tool is released from the liner hanger. Thus, if a complication arises during cementing, the operator can pull up and retrieve the setting tool and tubing string from the liner.

It will be apparent to those skilled in the art that various changes may be made in the invention without departing from the spirit and scope thereof and therefore the invention is not limited by that which is enclosed in the drawings and specifications, but only as indicated in the appended claims.

I claim:

1. A setting tool for setting a liner hanger in a well bore where the liner hanger is adapted for coupling to a liner and the setting tool is adapted for coupling to a string of pipe extending to the earth's surface, said setting tool including:

an elongated, tubular setting tool mandrel having a load supporting flange portion;

nut means slidably and non-rotatively mounted on said mandrel above said flange portion, said nut means having a first exterior threaded portion for threaded coupling to an internal first threaded portion of said liner hanger;

a tubular clutch housing slidably disposed on said setting tool mandrel and having an internal second threaded portion as well as a clutch means for interengaging said clutch housing with said liner hanger;

said nut means having a second external threaded portion for threaded coupling to the internal second threaded portion in said clutch housing; and release means for releasably coupling said nut means to said liner hanger for co-rotation in one condition and releasable to permit rotation of said nut means relative to said liner hanger in a second condition.

2. The apparatus as set forth in claim 1 wherein said release means includes a locking dog connection between said nut means and said liner hanger.

3. The apparatus as set forth in claim 1 and further including bearing means on said setting tool mandrel for engaging said clutch housing and for facilitating respective rotation of said nut means relative to said liner hanger and to the clutch housing.

4. The apparatus as set forth in claim 1 wherein said clutch means are disengageable upon relative improvement of said clutch housing away from said liner hanger.

5. A setting tool and liner hanger system for use in rotating a liner attached to a liner hanger prior to and subsequent to setting of said liner hanger, said system including:

a tubular liner hanger having an internal threaded coupling for releasable coupling to a setting tool, and means for hanging said liner hanger and said liner in a well casing;

a setting tool having an external threaded nut means for releasable coupling to said internal threaded coupling in said liner hanger;

first coupling means on said setting tool including a clutch housing for releasably coupling to said liner hanger for imparting co-rotation thereto when coupled;

second coupling means on said setting tool for releasably coupling said threaded nut means to said liner hanger for imparting co-rotation thereto when coupled;

said threaded nut means on said setting tool being threadedly connected to said clutch housing for selectively coupling said clutch housing to said setting tool upon release of said second coupling means;

said second coupling means being operatively coupled prior to hanging said liner hanger in a well casing and being releasable to permit setting tool rotation to release said external threaded nut means from said internal threaded coupling and to actuate said threaded nut means to couple said clutch housing to said setting tool so that said liner can be rotated after said external nut mans is released from said internal threaded coupling.

6. The apparatus as set forth in claim 5 wherein said first coupling means includes interengaging clutch surfaces on said clutch housing and said setting tool.

7. The apparatus as set forth in claim 5 wherein said second coupling means includes a lug and recess interconnection.

8. A setting tool and liner hanger system for enabling rotation of a liner hanger and an attached liner through rotation of a setting tool and an attached string of tubing prior to and subsequent to setting of said liner hanger, said liner hanger having an internal coupling thread at one end thereof, and having wall engaging means for gripping a casing wall to suspend said liner in a well bore and having bearing means for enabling rotation of said liner relative to the wall engaging means, said liner hanger having an annular recess below said coupling thread;

a setting tool having a load supporting tubular mandrel with a coupling nut means having an external coupling thread to releasably couple the setting tool to the internal coupling thread on said liner hanger, said coupling nut means being slidably and co-rotatively coupled to said mandrel;

a clutch housing slidably disposed on said mandrel, said clutch housing having clutch means for releasably coupling to said liner hanger, said clutch housing having an internal recess with an internal threaded section;

said coupling nut means having an external thread portion in engagement with said internal threaded section on said clutch housing;

interconnecting means for releasably interconnecting sad coupling nut means to said liner hanger recess and maintaining said coupling nut means coupled to said liner hanger so that said liner hanger can be rotated with said setting tool prior to release of said setting tool from said liner hanger; and said mandrel being manipulatable relative to said coupling nut means for enabling rotation of said coupling nut relative to said liner hanger to release said interconnecting means and for uncoupling said coupling nut means from said liner hanger and for locking said coupling nut means with said clutch housing so that said mandrel can rotate said liner after release of said coupling nut means from said liner hanger.

9. The apparatus as set forth in claim 8 wherein said clutch means includes interengaging surfaces on said clutch housing and said liner hanger.

10. The apparatus as set forth in claim 8 wherein said interconnecting means includes longitudinally extending fingers and lug portions on said coupling nut member means.

11. A setting tool for setting a liner hanger in a well bore where the liner hanger is adapted for coupling to a liner and the setting tool is adapted for coupling to a string of pipe extending to the earth's surface, said setting tool including:

an elongated, tubular setting tool mandrel having a load supporting flange portion;

a tubular clutch housing slidably disposed on said setting tool mandrel and having an internal threaded recess portion as well as a clutch means for interengaging said clutch housing with said liner hanger;

coupling nut means slidably and non-rotatively mounted on said mandrel and located above said flange portion and below said clutch housing, said coupling nut means having an exterior thread for threaded coupling to an internal threaded portion of said liner hanger and to the threaded recess portion of the clutch housing;

said coupling nut means having locking means for releasably coupling said nut means to said liner hanger in a first longitudinal position of said mandrel, said locking means being releasable when said mandrel is in a second longitudinal position so that said coupling nut means can be threadedly released from the liner hanger and lock up in said clutch housing.

12. The apparatus as set forth in claim 11 wherein said locking means includes a lug and recess interconnection between said liner hanger and said setting tool mandrel.

13. The apparatus as set forth in claim 11 and further including bearing means on said setting tool mandrel for engaging said clutch housing for facilitating rotation of said coupling nut means relative to the liner hanger and to the clutch housing.

14. The apparatus as set forth in claim 11 wherein said coupling nut means is located in said internal threaded release portion sot hat the coupling nut means will be releasable from said liner hanger prior to the engaging an end surface in said internal threaded release portion.

15. The apparatus as set forth in claim 11 wherein said clutch means are disengageable upon relative movement of said clutch housing away from said liner hanger.

16. A setting tool for setting a liner hanger in a well bore where the liner hanger is adapted for coupling to a liner and the setting tool is adapted for coupling to a string of pipe extending to the earth's surface, said setting tool including:

an elongated,, tubular setting tool mandrel having a load supporting flange portion;

nut means slidably and non-rotatively mounted on said mandrel above said flange portion, said nut means having a first exterior thread for threaded coupling to an internal first threaded portion of said liner hanger;

a tubular clutch housing slidably disposed on said setting tool mandrel and having an internal second threaded portion as well as a clutch mans for interengaging said clutch housing with said liner hanger;

said nut means having a second external thread for threaded coupling to the internal second threaded portion in said clutch housing; and release means for releasably coupling said clutch housing to said setting tool mandrel for co-rotation in one condition and releasable to permit rotation of said setting tool mandrel relative to said clutch housing in a second condition.

17. The apparatus as set forth in claim 16 wherein said release means includes a shear pin connection between said clutch means and said setting tool mandrel.

18. The apparatus as set forth in claim 16 wherein said release means includes a spline dog and spline groove connection between said clutch housing and said setting tool mandrel.

19. The apparatus as set forth in claim 16 and further including bearing means on said setting tool mandrel for engaging said clutch housing and for facilitating respective rotation of said nut means relative to said liner hanger and to the clutch housing.

20. The apparatus as set forth in claim 19 wherein said nut means includes a lock nut member located in said internal second threaded portion and a coupling nut member in said first threaded portion, said coupling nut member being arranged for release from said liner hanger prior to the lock nut member engaging an end surface in said internal threaded portion.

21. The apparatus as set forth in claim 20 wherein said clutch mans are disengageable upon relative improvement of said clutch housing away from said liner hanger.

22. A liner hanger for use in hanging a liner in a well bore and for permitting rotation of said liner after said liner hanger is set in a well casing, said liner hanger including;

a tubular member having an internally threaded portion for releasable connection to a setting tool nut, said tubular member having an upwardly facing end surface having a shaped surface to define clutch surfaces;

said tubular member having an internally annular locking recess located below said threaded portion;

support means on said tubular member for engaging the wall of a well casing for hanging said liner hanger in a well casing; and rotative connection means between said support means and said tubular member for permitting rotation of the tubular member relative to the support means.

23. A method of hanging and rotating a liner in a well casing during a completion operation comprising the steps of:

lowering a setting tool and a liner hanger into a well bore where the setting tool is attached to a string of pipe and the liner hanger is attached to the liner and where the setting tool is releasably coupled to the liner hanger by coupling nut means threadedly connected to the liner hanger and the coupling nut means is releasably locked to the liner hanger to prevent rotation;

upon reaching a desired setting location, hanging the liner hanger in the well casing to support the weight of the liner and to permit rotation of the liner;

manipulating the string of pipe to unlock the coupling nut means from the liner hanger, rotating the coupling nut means to a released and uncoupled condition relative to the liner hanger while rotating the coupling nut mans into a clutch housing and into a locking position in the clutch housing so that weight can be applied to the clutch housing to engage said clutch housing with a liner; and applying weight to the string of pipe to engage said clutch housing with the liner when the coupling nut means is released and the coupling nut means are in a locking position so that the liner can be rotated by rotation of the string of pipe.

* * * * *